United States Patent [19]

Hattori

[11] Patent Number: 4,875,070

[45] Date of Patent: Oct. 17, 1989

[54] METHOD OF REMOVING TONER FROM A ROTATING DRUM IN A XEROGRAPHIC COPYING MACHINE USING A VIBRATING BLADE

[75] Inventor: Yutaka Hattori, Kamakura, Japan

[73] Assignee: The Yokohama Rubber Co., Ltd., Tokyo, Japan

[21] Appl. No.: 138,082

[22] Filed: Dec. 28, 1987

[30] Foreign Application Priority Data

Dec. 30, 1986 [JP] Japan ..... 61-311727

[51] Int. Cl.[4] ..... G03G 21/00; G03G 15/06

[52] U.S. Cl. ..... 355/299; 355/296; 430/125; 118/652

[58] Field of Search ..... 355/15, 3 DD; 222/DIG. 1; 118/652; 430/125; 15/256.5-256.53

[56] References Cited

U.S. PATENT DOCUMENTS

| | | | |
|---|---|---|---|
| 3,854,814 | 12/1974 | Jones | 355/15 |
| 4,007,982 | 2/1977 | Stange | 355/15 |
| 4,111,545 | 9/1978 | Meltzer | 355/15 |
| 4,145,137 | 3/1979 | Sunaga et al. | 355/15 |
| 4,518,248 | 5/1985 | Nishikawa | 355/15 |

OTHER PUBLICATIONS

Xerox Disclosure Journal, v. 1, No. 4, Apr. 1976, Vibrating Cleaning Blade for Photoreceptor.

*Primary Examiner*—A. T. Grimley
*Assistant Examiner*—Ed Pipala
*Attorney, Agent, or Firm*—Finnegan, Henderson, Farabow, Garrett, Dunner

[57] ABSTRACT

A method of removing a toner deposited on a rotating drum in a xerographic copying machine, comprises: positioning a blade with its scraping edge positioned closely adjacent to a surface of the drum; and imparting vibrations to the blade so as to bring the scraping edge alternately into and out of contact with the surface of the drum at short time intervals.

3 Claims, 2 Drawing Sheets

METHOD OF REMOVING TONER FROM A ROTATING DRUM IN A XEROGRAPHIC COPYING MACHINE USING A VIBRATING BLADE

BACKGROUND OF THE INVENTION

1. Field of the Invention

This invention relates to xerography and more particularly to a method of removing toner deposits from a photosensitive drum in a xerographic copying machine.

2. Description of the Prior Art

One of the most popular printing or copying technology nowadays is xerography in which an electrostatic latent or negative image corresponding to an original print to be copied is formed on an electrically charged layer of a photosensitive material such as selenium provided on a rotary drum and then an oppositely charged toner in the form of a resinous powder is electrostatically adsorbed onto and tones the latent image which is finally transferred onto a print paper through the medium of heat. The conventional xerography process suffers from the problem that the toner is difficult to transfer in its entirely to the print paper, resulting in a portion of the toner remaining on the drum. It has been a common practice to scrape the residual toner off the drum by pressing a blade of a synthetic resin such as polyurethane against the drum.

FIG. 6 of the accompanying drawings schematically illustrates a typical xerographic copying machine 1 in which exposing, developing and transferring are carried out in this order as a photosensitive drum 2 makes a full clockwise rotation in the direction indicated by an arrow. Light from a light source 3 is irradiated to the original 5 placed on a sheet of glass 4, and the light reflected therefrom is focused on the drum 2 by a bar lens 6. The copying machine 1 is designed to move the original 5 relative to the light source 3 and the lens 6 in synchronism with the rotation of the drum 2, whereby the photosensed or exposed areas of the original are formed to appear as an inverted latent image on the drum 2. The exposed image on the drum 2 is developed on a developer drum 8 by a toner from a reservoir 7 and then moved to a transfer station 11 where a print paper supplied from a cartridge 9 is pressed against the drum 2 to pick up the developed image. Subsequently, the transferred image is fixed or settled on the paper as the latter is pressed on opposite sides by a heat roller 13 and a pressure roller 14. The paper is thereafter discharged out of the copying machine 1 onto a tray 16 by the heat roller 13 and the pressure roller 14. The toner that has been deposited on the pressure roller 14 during image fixation is removed by a cleaning roller 17.

In the meantime, the portion of the toner that has been left during the transfer process on the drum 2 is scraped off by the blade 18 and placed in a collector 19. However, to ensure complete removal of the residual toner, the blade 18 must have a scraping edge of a high degree of precision and hence is expensive to manufacture. Furthermore, because the blade 18 must be pressed against the drum 2 with great physical force, the blade edge tends to wear out rapidly due to friction and is otherwise vulnerable to damage on contact with foreign matter such as dust jammed between the blade edge and the drum surface.

SUMMARY OF THE INVENTION

It is therefore an object of this invention to provide a novel method of effectively removing residual toners from a xerographic copying machine which will eliminate wear or damage of the blade edge. The invention also makes it possible to use a scraping blade of less stringent precision and hence less costly product.

According to the present method, vibrations or oscillations are imparted to the blade so as to bring its edge alternately into and out of contact with the drum in rotation at such short time intervals as is required for the specifications of the blade and its associated operating parts.

Many other objects, features and additional advantages of the present invention will become manifest to those versed in the art upon making reference to the detailed description and the accompanying sheets of drawings in which preferred structural embodiments incorporating the principle of this invention are shown by way of illustrative example.

DETAILED DESCRIPTION

The principles of this invention are particularly useful when applied to a xerographic copying machine, in which toner leftovers on a photosensitive drum are to be removed by a blade after image transfer is effected.

Figure 1:
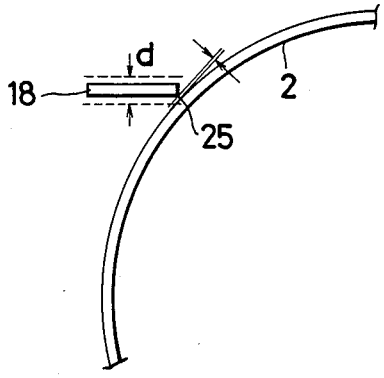
FIG. 1 is a schematic side elevational view of a portion of a xerographic copying machine, showing the position of a scraping blade relative to a photosensitive drum according to the invention.

As shown in FIG. 1, a blade 18 in its vibration-free position has its edge 25 spaced about $0.1\mu$ from the surface of a photosensitive drum 2. The blade 18 is inclined with respect to the direction of rotation of the drum 2 toward a position to which removed toner particles fall. According to a first mode of operation shown in FIGS. 2 and 3, the blade 18 is cantilevered by a fixed support 21 (FIG. 3) which is secured to one corner of the blade 18 near one end 20 and remote from the edge 25.

Figure 2:
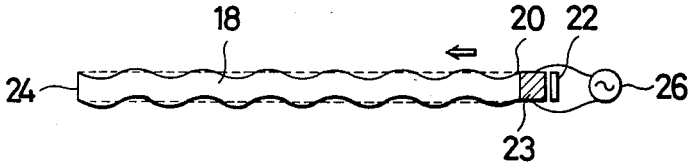
FIG. 2 is an enlarged front elevational view of the blade, showing a first mode of operation in which vibrations are imparted to the blade from one end thereof.
Figure 3:
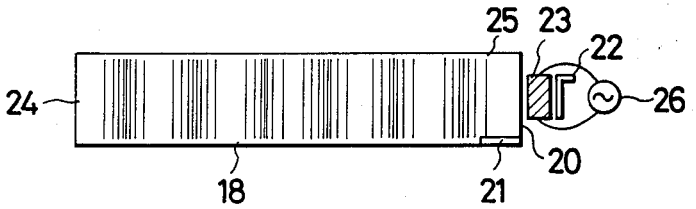
FIG. 3 is a plan view of FIG. 2.

A piezoelectric element 23, as shown in FIGS. 2 and 3, is fixedly attached to the end 20 of the blade 18 by means of a bracket 22. An oscillator 26 is connected to the piezoelectric element 23 for exciting transverse vibrations on the blade 18 so that the vibration waves run longitudinally along the blade 18 from one end 20 toward the other end 24. In FIG. 3, a striped pattern on the blade 18 is imaginary and indicates the run of the waves of FIG. 2.

The vibrations are produced by a high-frequency voltage applied from the oscillator 26. As shown in FIG. 2, the amplitude of the vibrations is such that the edge 25 of the blade quickly and actively hits the surface of the drum 2 to produce a kinetic force tending to drive toner residues out of the drum surface.

Figure 4:
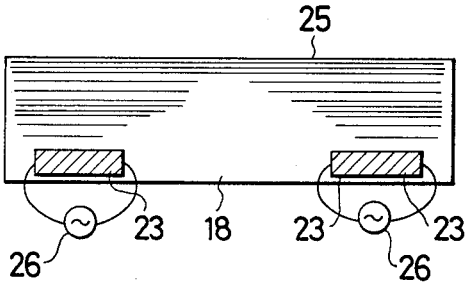
FIG. 4 is an enlarged plan view of the blade, showing a second mode of operation in which vibrations are given to the blade from one edge thereof remote from the drum.
Figure 5:
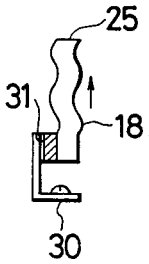
FIG. 5 is an end view of FIG. 4.
Figure 6:
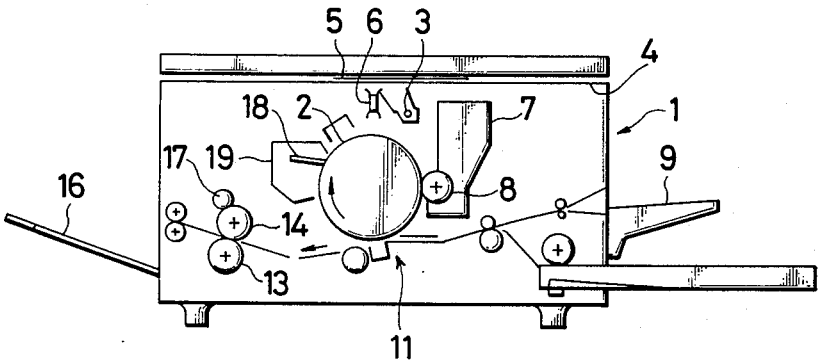
FIG. 6 is a schematic front elevational view of a conventional xerographic copying machine.

FIGS. 4 and 5 illustrate a second mode of operation in which the vibration waves run transversely across the blade 18 toward the scraping edge 25. A pair of piezoelectric elements 23, 23 is fixedly attached to the blade 18 remote from the scraping edge 25. The two piezoelectric elements 23, 23 are spaced from each other along the blade 18. The number of the piezoelectric elements 23 may be selected as desired depending upon the size of the blade 18. As shown in FIG. 5, each piezoelectric element 23 is secured to a bracket 30 as by a double-faced adhesive tape 31, the bracket 30 being supported on the frame of the copying machine 1.

The vibrations to be imparted to the blade 18 are transverse waves and preferably non-standing waves, e.g. running waves, but may be in any other suitable form.

According to the method of the invention, since the blade is vibrated in a manner to brush the surface of the drum, the toner can be removed therefrom at a many fold rate of speed and accuracy without need of forcing the blade against the drum as was conventionally done.

If the frequency of the transverse waves is too low with respect to the running speed of the waves, there can be provided literally only so much low wave density. If the frequency is conversely too high, the blade would fail to follow or track the vibrations, resulting in a loss of energy. In the event that a piezoelectric element is used, the preferred frequency range is from several kHz to several hundreds of kHz. Alternatively, the vibrations may be a combination of two or more kinds of vibrations of different frequencies, e.g. several kHz and several tens kHz, which will enhance efficiency of toner removal.

The preferred amplitude range of the vibrations for ordinary copying machines is from several $\mu$ to several hundreds of $\mu$. Departures from this range would lead to ineffective vibrations. Non-standing waves may be produced by vibrations of non-stable frequency.

The exciting means for imparting vibrations to the blade is preferably, though not limited to, a piezoelectric element such as of barium titanate, Rochelle salt or quartz for ordinary copying machines. As vibrations are given to the fixed end or edge of the cantilevered blade, the vibration waves run efficiently toward the free end or edge of the blade.

Although the blade may be positioned with respect to the drum in the conventional manner, the blade edge should preferably be spaced from the drum across a fine gap. For example, if vibrations of $20\mu$ amplitude are given to the blade with its scraping edge spaced from the drum by a gap of about $0.1\mu$, it is possible to remove the toner off the drum as effectively as is by the conventional method.

The material for the blade in the invention may be the same as is conventionally used.

In the illustrated examples, the present method is applied to a xerographic copying machine of any known type, in which used toners on the drum are to be removed. The present method may also be applied to remove toners from the cleaning drum.

According to the invention, since the running waves of vibrations are imparted to the blade with its scraping edge spaced closely from or slightly in contact with the drum, it is possible to hold abrasive wear and other damage of the blade to an absolute minimum.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of removing a toner deposited on a rotating drum in a xerographic copying machine, comprising:

(a) positioning a blade having a scraping edge which is disposed closely adjacent the outer surface of the drum, the blade being defined by said scraping edge, an outer edge opposite said scraping edge and remote from the drum and two opposite end edges, the blade having a width extending between said scraping edge and said outer edge and a length extending between said end edges; and (b) imparting vibrations to the blade from one of said edges other than said scraping edge to produce non-standing vibration waves which run through the blade to bring said scraping edge alternately into and out of contact with the outer surface of the drum at short time intervals so as to remove toner therefrom.

2. A method according to claim 1, wherein said non-standing waves run longitudinally along the length of the blade from one of said end edges toward the other end edge.

3. A method according to claim 1, wherein said non-standing waves run across the width of the blade from said outer edge toward the scraping edge.

* * * * *